United States Patent [19]

Dedrick

[11] Patent Number: 4,718,316

[45] Date of Patent: Jan. 12, 1988

[54] NUT-HOLDER ATTACHMENT FOR A WRENCH

[76] Inventor: Ted R. Dedrick, 3427 Mt. Laurence Dr., San Diego, Calif. 92117

[21] Appl. No.: 912,640

[22] Filed: Sep. 26, 1986

Related U.S. Application Data

[63] Continuation of Ser. No. 707,834, Mar. 4, 1985, abandoned.

[51] Int. Cl.[4] ..... B25B 13/02

[52] U.S. Cl. ..... 81/125; 81/180.1

[58] Field of Search ..... 81/125, 451, 180.1

[56] References Cited

U.S. PATENT DOCUMENTS

| | | | |
|---|---|---|---|
| 2,697,371 | 12/1954 | Bowman | 81/125 X |
| 3,731,722 | 5/1973 | Carr | 81/125 X |
| 4,016,783 | 4/1977 | Spector et al. | 81/125 X |
| 4,406,188 | 9/1983 | Mills | 81/125 X |

*Primary Examiner*—Frederick R. Schmidt
*Assistant Examiner*—Maurina Rachuba
*Attorney, Agent, or Firm*—Charles C. Logan, II

[57] ABSTRACT

A nut-holder attachment that can be detachably attached to a common wrench, has a shank member having a front spring finger connected to its forward end and a rear spring finger connected to its rearward end. A spring clip is connected to the shank member for attaching the nut-holding attachment to the shank portion of a wrench. The forward end of the front spring member has an aperture therein and an elongated stem freely passes therethrough. The top end of the stem is connected to the bottom surface of a magnetic head. A head is formed on the bottom end of the stem to prevent its withdrawal through the aperture. The magnetic head is formed from a disc shaped magnet glued onto a plastic disc.

6 Claims, 10 Drawing Figures

NUT-HOLDER ATTACHMENT FOR A WRENCH

This application is a continuation of prior U.S. application Ser. No. 707,834, filed on Mar. 4, 1985, now abandoned.

BACKGROUND OF THE INVENTION

The invention relates to devices for temporarily holding a nut in place between the jaws of a wrench to facilitate the starting of nuts on bolts located in positions of comparative inaccessibility.

In the past nut-holders for wrenches have been designed that detachably clip onto the shank portion of a wrench. U.S. Pat. No. 2,369,400 discloses a nut-holder having a pair of spring fingers 7 and 8 that are compressed together and then inserted into the bore of a nut for holding it in position. U.S. Pat. No. 2,557,628 discloses a nut-holding attachment that utilizes a pair of arms 22 and 23 to capture a nut between itself and the open jaw of the wrench. U.S. Pat. No. 2,697,371 discloses a wrench attachment having a slide member 6 whose enlarged ends 7 and 8 are slid longitudinally to cover a portion of the open jaw of the wrench in order to capture the nut therebetween. The most recent nut-holder attachment for a wrench is disclosed in U.S. Pat. No. 4,406,188. It utilizes a pair of fingers 15 and 16 having tab portions 17 and 18 that capture the nut therebetween.

It is an object of the invention to provide a novel nut-holder attachment for a wrench for facilitating starting the nuts upon bolts located in a location inaccessible for both hands of the person using the wrench.

It is also an object of the invention to provide a novel nut-holder attachment that fits a range of wrench sizes and types.

It is also an object of the invention to provide a novel nut-holder attachment that may be used with an open jaw wrench or a closed jaw wrench or a wrench having its jaw angularly offset with respect to its shank portion.

It is another object of the invention to provide a novel nut-holder attachment for a wrench that is simple in construction and comparatively economical to manufacture.

It is an additional object of the invention to provide a novel nut-holder attachment for a wrench that may be easily attached or removed from a wrench.

SUMMARY OF THE INVENTION

Applicant's novel nut-holder attachment for a wrench can be used with both an open jaw wrench and a closed jaw wrench. Additionally it may be used with wrenches whose jaws are oriented at an angle to the longitudinal axis of the shank portion of the wrench. His nut-holder attachment utilizes a magnet for holding the nut in position within the jaws of the wrench.

The novel nut-holder attachment has an elongated shank portion having a front spring finger connected to its forward end and a rear spring finger connected to its rearward end. A spring clip is also connected to the shank member for attachng the nut-holding attachment to the shank portion of the wrench. An elongated stem has a magnetic head attached to its top end and its bottom end passes freely through an aperture in the forward end of the front spring member. A head formed on the bottom end of the stem prevents the stem from being removed from the front spring finger. The front spring finger has a rear section bent downwardly from the shank member and an intermediate section which is bent upwardly therefrom. A front lip on the forward end of the intermediate section is bent downwardly. The aperture in the front spring member is located substantially where the intermediate section and the front lip intersect one another. The freedom of the stem within the aperture allows the magnetic head to be universally pivoted so that it may more truely align with the surface of the jaws of a wrench.

Although the novel nut-holder attachment is illustrated as being formed from metal, it could also be formed from other materials (such as plastic, etc.).

An alternative version of the nut-holder attachment utilizes a novel spring clip and shank member structure. This version also utilizes magnets for holding the nut in its proper position within the jaws of a wrench. One end of the shank member is designed to function with a wrench having its jaw in the same plane as its shank portion and the other end of the shank member is designed to function with a jaw that is oriented at an angle to the longitudinal axis of the shank of the wrench.

DESCRIPTION OF THE PREFERRED EMBODIMENT

Figure 1:
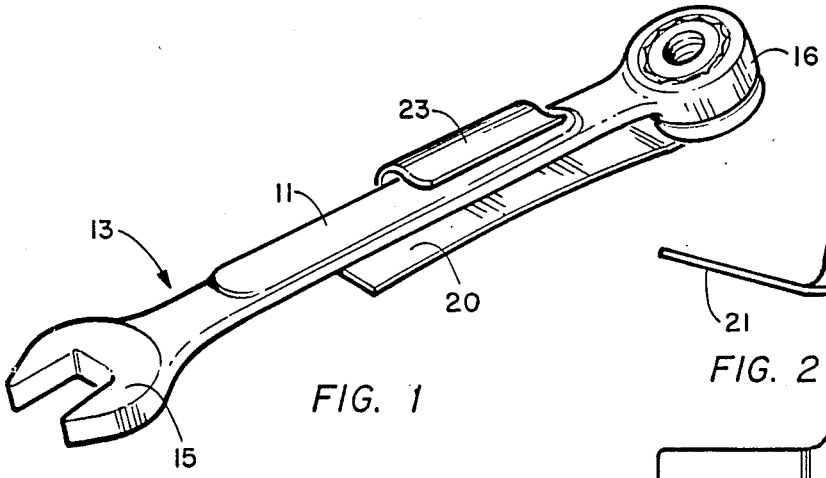
FIG. 1 is a perspective view illustrating the novel nut-holder attachment secured to a wrench.
Figure 2:
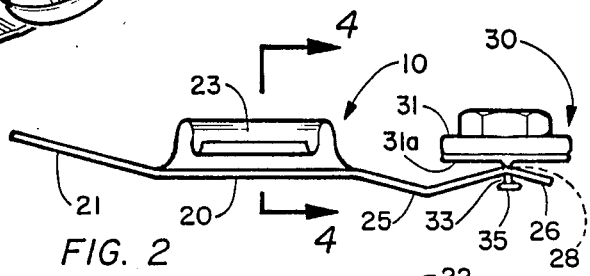
FIG. 2 is a side elevation view illustrating the novel nut-holder attachment.
Figure 3:
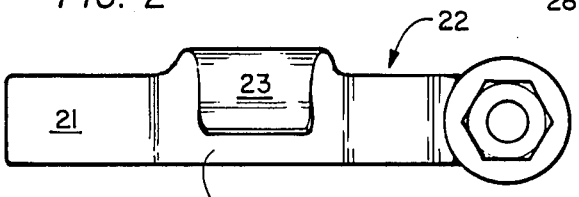
FIG. 3 is a top plan view of the novel nut-holder attachment for a wrench.
Figure 4:
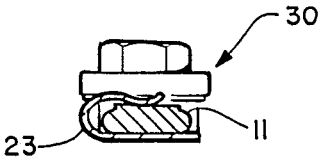
FIG. 4 is a cross-sectional view taken along lines 4—4 of FIG. 2.

Applicant's novel nut-holder attachment will now be described by referring to FIGS. 1–4 of the drawings. The novel nut-holder attachment is generally designated numeral 10.

Nut-holder attachment 10 is frictionally engaged on the shank portion 11 of wrench 13. Wrench 13 has an open end jaw 15 and a closed end jaw 16 that is angularly offset from the longitudinal axis of shank portion 11.

Nut-holder attachment 10 has a shank member 20 having a rear spring finger 21, a front spring finger 22, and a spring clip portion 23. Front spring finger 22 has a rear section 24, an intermediate section 25, and a front lip 26. An aperture 28 is formed approximately where the intermediate section 25 and front lip 26 intersect each other.

A magnetic head 30 has a disc shaped magnet 31 with a plastic disc **31*a* glued to its bottom surface. Plastic disk 31*a* has a stem 33 extending downwardly therefrom that passes through aperture 28 and has a head 35** formed on its lower end. This structure allows the magnetic head to be universally pivotable thereby allowing it to align the magnet surface on the end jaw of a wrench that is angularly offset from the longitudinal axis of its shank portion.

A first alternative version is illustrated in FIGS. 5–9. This nut-holder attachment is generally designated numeral 40. It has a shank member 41, a rear spring finger 43 and a front spring finger 45. Magnet 46 is attached to the top surface of rear spring finger 43. Magnets 48 and 49 are attached to the respective top and bottom surfaces of front finger 45. A slot 50 extends longitudinally along the shank member 41. A spring clip 52 is inserted therethrough. Spring clip 52 has an intermediate portion 55 having spring fingers 56 and 57 extending laterally therefrom. A groove 59 is formed on the outside lateral surface of spring clip 52.

Figure 10:
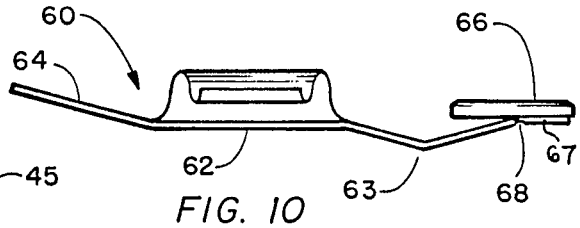
FIG. 10 is a side elevation view of a second alternative embodiment of the novel nut-holder attachment for a wrench.
Figure 5:
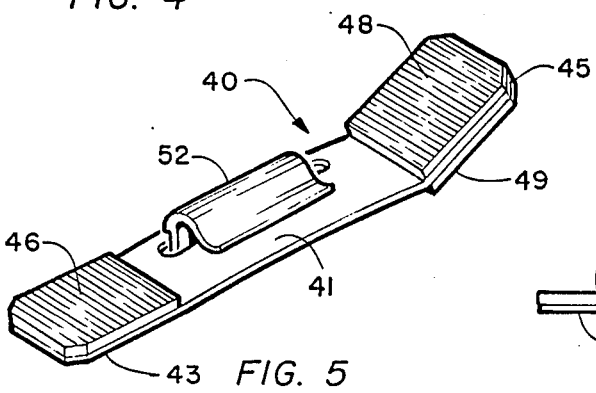
FIG. 5 is a first alternative embodiment of the novel nut-holder attachment for a wrench.
Figure 6:
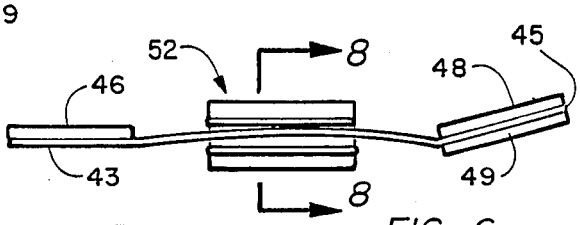
FIG. 6 is a side elevation view of the first alternative version of the novel nut-holder attachment for a wrench.
Figure 7:
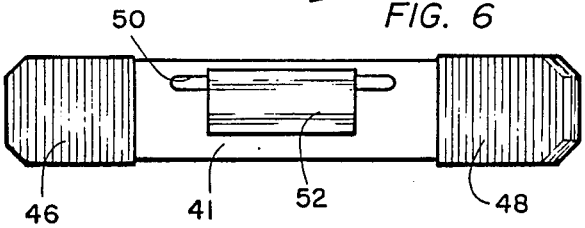
FIG. 7 is a top plan view of the first alternative version of the novel nut-holder attachment for a wrench.
Figure 8:
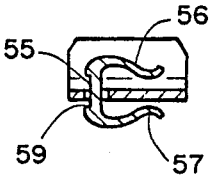
FIG. 8 is a cross-sectional view taken along lines 8—8 of FIG. 6.
Figure 9:
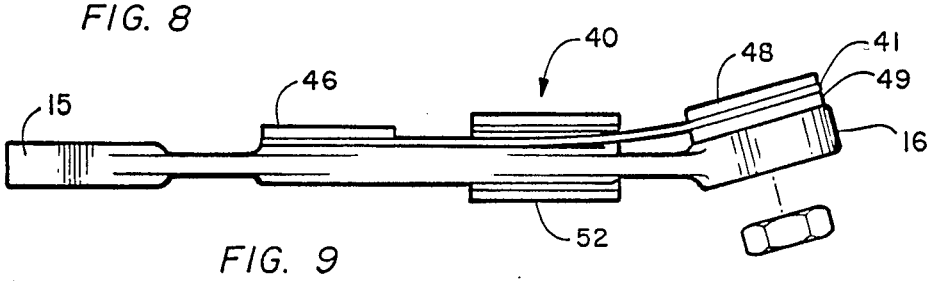
FIG. 9 is a side elevation view illustrating the first alternative version attached to a wrench.

A second alternative version is illustrated in FIG. 10. This nut holder is generally designated numeral 60 and it would be integrally molded from a material such as plastic. It has a shank portion 62, a front spring finger 63, and a rear spring finger 64. A magnet 66 is attached on its underside to the top of the integrally formed disc portion 67 which in turn is connected by an integral living hinge 68 to the forward end of front spring finger 63.

What is claimed is:

1. A nut-holder attachment for a wrench comprising:

a shank member having a forward end, a rearward end, lateral side edges, a top surface and a bottom surface;

a front spring finger connected to the forward end of said shank member;

a spring clip connected to said shank member for attaching said nut-holder attachment to the shank portion of a wrench;

a magnetic head having a top surface and a bottom surface;

pivot means connecting the bottom surface of said magnetic head to the top surface of said front spring member; and said shank member, said front spring member, and said spring clip are integrally formed from plastic and said pivot means is in the form of an integral living hinge having a disc portion upon whose top surface said magnetic head is attached.

2. A nut-holder attachment for a wrench comprising:

a shank member extending in a longitudinal direction and having a forward end, a rearward end, lateral side edges, a top surface and a bottom surface;

a front spring finger extending in the same longitudinal direction as said shank member and being connected to the forward end of said shank member;

a spring clip connected to said shank member for attaching said nut-holder attachment to the shank portion of a wrench;

a magnetic head assembly having a top surface and a bottom surface; and pivot means connecting the bottom surface of said magnetic head assembly to the top surface of said front spring member.

3. A nut-holder attachment as recited in claim 2 wherein said pivot means comprises an elongated stem having a top end and a bottom end, said top end being connected to the bottom surface of said magnetic head assembly, said stem having a predetermined diameter that freely passes through an aperture in the forward end of said front spring member, and a head formed on the bottom end of said stem.

4. A nut-holder attachment as recited in claim 3 wherein said magnetic head assembly is formed from a disc shaped magnet glued onto a plastic disc.

5. A nut-holder attachment as recited in claim 3 wherein said front spring finger has a rear section that slopes downwardly from said shank member, an intermediate section that slopes upwardly from said rear section, and a front lip that slopes downwardly from said intermediate section.

6. A nut-holder attachment as recited in claim 2 further comprising said shank member having a rear spring finger connected to the rear end of said shank member.

* * * * *